US005479076A

United States Patent [19]

Moberg

[11] Patent Number: 5,479,076

[45] Date of Patent: Dec. 26, 1995

[54] CURRENT MODE RESTART CIRCUIT FOR A DC ARC LAMP

[75] Inventor: Gregory O. Moberg, Rochester, N.Y.

[73] Assignee: Eastman Kodak Company, Rochester, N.Y.

[21] Appl. No.: 255,029

[22] Filed: Jun. 7, 1994

[51] Int. Cl.[6] ..... H05B 37/02

[52] U.S. Cl. ..... 315/307; 315/DIG. 7; 315/224; 315/209 R

[58] Field of Search ..... 315/289, 290, 315/307, 291, 311, 176, DIG. 7, 224, 209 R

[56] References Cited

U.S. PATENT DOCUMENTS

| | | | |
|---|---|---|---|
| 4,340,843 | 7/1982 | Anderson | 315/205 |
| 4,723,097 | 2/1988 | Heindl et al. | 315/289 |
| 4,763,044 | 8/1988 | Nuckolls et al. | 315/176 |
| 4,949,018 | 8/1990 | Siglock | 315/225 |
| 5,018,019 | 5/1991 | Moore | 358/215 |
| 5,019,751 | 5/1991 | Flory, IV et al. | 315/290 |
| 5,051,665 | 9/1991 | Garrison et al. | 315/287 |
| 5,051,667 | 9/1991 | Dunham | 315/307 |
| 5,053,683 | 10/1991 | Theroux | 315/290 |
| 5,068,570 | 11/1991 | Oda et al. | 315/128 |
| 5,103,137 | 4/1992 | Blake et al. | 315/119 |
| 5,142,203 | 8/1992 | Oda et al. | 315/308 |
| 5,151,634 | 9/1992 | Nepote et al. | 315/307 |

*Primary Examiner*—Robert J. Pascal
*Assistant Examiner*—David H. Vu
*Attorney, Agent, or Firm*—David M. Woods

[57] ABSTRACT

A restart circuit for a dc arc lamp, which is subject to power variations that cause the lamp to extinguish, includes a power circuit for supplying the dc arc lamp with current that has a constant current value while the lamp is operating. A current monitor connected to the power circuit monitors the current supplied to the dc arc lamp and provides a current sense signal corresponding to the supplied current. A comparator, which is connected to receive the current sense signal, provides a restart signal having a hysteresis characteristic. The restart signal is activated when the current sense signal falls a first predetermined value below the constant current value (indicating that the lamp has extinguished) and deactivated when the current sense signal rises above a second predetermined value greater than said first predetermined value, but still less than the constant current value. An ignition circuit responsive to the restart signal then supplies the dc arc lamp with an ignition voltage to restart the lamp.

10 Claims, 2 Drawing Sheets

CURRENT MODE RESTART CIRCUIT FOR A DC ARC LAMP

FIELD OF THE INVENTION

The invention relates generally to the field of power supplies for light sources, and in particular to a power supply for a dc arc lamp.

BACKGROUND OF THE INVENTION

A power supply for a dc arc lamp is frequently provided with an automatic restart feature, whereby if the lamp is extinguished (due to, say, supply voltage fluctuations), the supply will sense this condition and automatically restart the lamp. The traditional restart method is based on sensing when the lamp voltage has exceeded a certain threshold value. When this condition is sensed, a lamp igniter circuit is activated until the lamp restarts and the lamp voltage drops below the threshold. Under certain circumstances toward the end of lamp life, however, the operating lamp voltage will rise, and the restart circuit may attempt to restart an operating lamp. This can result in destruction of the restart circuit.

It is also known to use lamp current as the restart criterion for ac lamps. A typical example of current control is shown in U.S. Pat. No. 4,763,044, in which a current sensing relay is connected in series in the lamp return line. If current is interrupted, the relay closes and thereby applies a series of high voltage oscillations to the lamp to restart conduction through the lamp. The relay then opens at some current value short of the operating current, and the lamp continues to draw ac current from the ac supply.

AC supplies, such as the one described in the '044 patent, provide considerable ac ripple in the drive current for an ac lamp. The resulting variations in lamp illumination is unimportant for the usual applications of such lamps, such as for street lamps. However, such ripple cannot be tolerated in systems where the level of illumination is being measured, as, e.g., in a film scanning system in which the lamp illuminates a transparent film and the transmitted illumination is measured by a photosensor. Consequently, the skilled designer of film scanners would not turn to such supplies to power a scanner lamp.

It is accordingly desirable to use a constant current dc lamp in a film scanning system. Ripple is ordinarily not evident and the illumination can be very constant. The need remains, however, to restart such a lamp without endangering the restart circuit as the lamp ages, such as the known voltage restart circuits are prone to do.

SUMMARY OF THE INVENTION

The present invention is directed to overcoming one or more of the problems set forth above. Briefly summarized, according to one aspect of the present invention, a restart circuit for a dc arc lamp subject to power variations that cause the lamp to extinguish is arranged to monitor the operating current. The restart circuit includes a power circuit for supplying the dc arc lamp with current that has a constant current value while the lamp is operating. A current monitor connected to the power circuit monitors the current supplied to the dc arc lamp and provides a current sense signal corresponding to the supplied current. A comparator is connected to receive the current sense signal and to provide a restart signal having a hysteresis characteristic, the restart signal being activated when the current sense signal falls a first predetermined value below the constant current value and being deactivated when the current sense signal rises above a second predetermined value greater than said first predetermined value, but still less than the constant current value. An ignition circuit responsive to the restart signal then supplies the dc arc lamp with an ignition voltage to restart the lamp.

The advantage of the invention lies in the fact that the current restart criterion can be selected so that it is well below the operating lamp current, regardless of the age of the lamp. Consequently, unlike a voltage-based restart circuit, a current-based restart circuit according to the invention will not attempt to restart an operating lamp, with attendant destruction of the restart circuit.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

The invention will be described in relation to the FIGURES, in which.

DETAILED DESCRIPTION OF THE INVENTION

Figure 1:
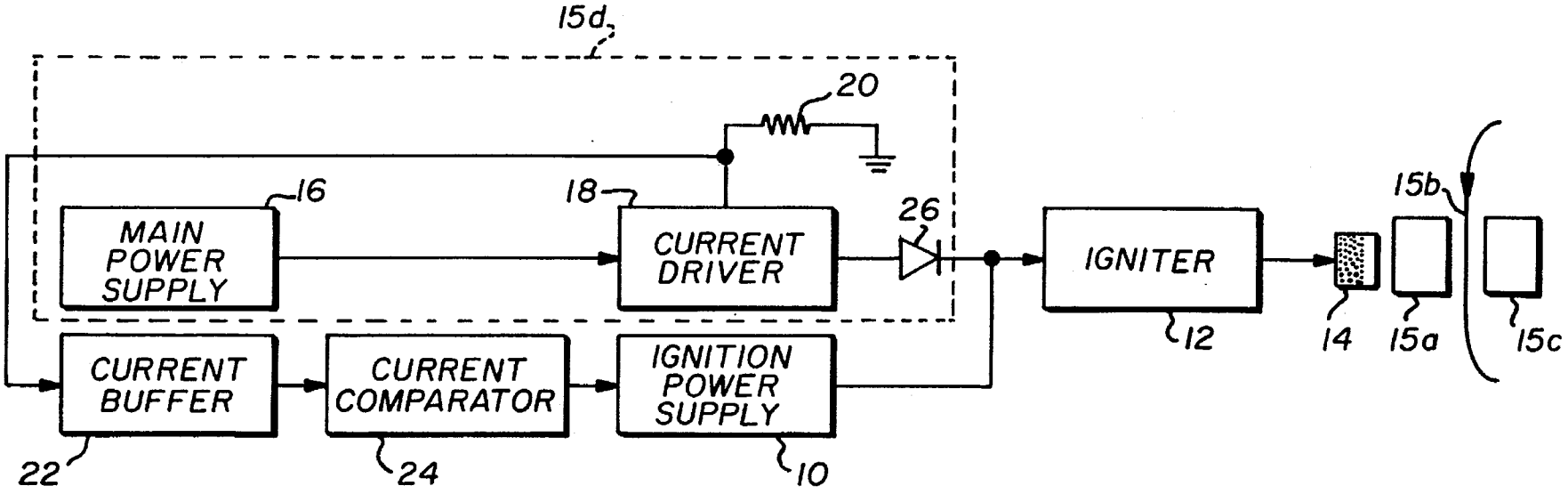
FIG. 1 is a block diagram of a current mode restart circuit for a dc arc lamp for a film scanner, shown in accordance with the invention.

FIG. 1 is a block diagram of a current mode arc lamp restart circuit arranged according to the invention, showing in particular how a current triggered ignition power supply 10 is connected through an igniter circuit 12 to a dc arc lamp 14. A preferred arc lamp for film scanning is a dc xenon arc lamp. FIG. 1 further shows the dc arc lamp 14 directing light into the input port of an integrating cavity 15*a*, which illuminates a section of a film 15*b* travelling between the integrating cavity 15*b* and a photosensor assembly 15*c*. As explained earlier, it is very important that the illumination from the lamp 14 is highly regular and uniform, and without any ripple, so that the photocell assembly 15*c* registers only variations in illumination due to the image dyes in the film 15*b*. A power circuit 15*d* for the lamp includes a main power supply 16 and a current driver 18.

The main power supply 16 provides the high current and low voltage needed by the lamp 14 to produce light, while the current driver 18 is a feedback controlled driver that provides a constant dc current value while the lamp 14 is operating. Current feedback for the current driver 18 is taken across a sense resistor 20, which is also used to monitor the current applied to the dc arc lamp 14. As shown in this diagram, the functionality for monitoring current includes the current sense resistor 20 and a current buffer 22, which is arranged as a simple buffer with gain. The current sense resistor 20 monitors the current supplied to the dc arc lamp 14 and outputs a voltage corresponding to the supplied current to the current buffer 22. The buffer 22 applies gain to its input voltage signal and outputs a current sense signal indicative of lamp current.

The current sense signal is received by a comparator 24 with a hysteresis characteristic. Hysteresis is provided by two trigger levels, both below the lowest constant current value provided by the current driver 18 for operating the lamp 14. When the lamp 14 is extinguished, current through the current driver 18 drops rapidly toward zero. At the lower of the two trigger levels, the comparator 24 is triggered and outputs a restart signal to the ignition power supply 10. The ignition power supply 10 then outputs an ignition trigger voltage to the igniter 12, which provides the initial high voltage pulse to ionize a path through the lamp 14 and to restart the arc. At the same time, the high voltage backbiases a diode 26 to isolate the current driver 18 during ignition.

As the lamp 14 is ignited, it begins to draw enough current to forward bias the diode 26 and draw current through the current driver 18. The rapidly rising current is sensed by the current sense resistor 20 and a corresponding, rapidly rising current sense signal is provided to the comparator 24. When the current sense signal passes the higher of the two trigger levels, the restart signal is deactivated and the ignition power supply 10 is shut down. The lamp 14 then resumes operation at its constant dc operating current.

Figure 2:
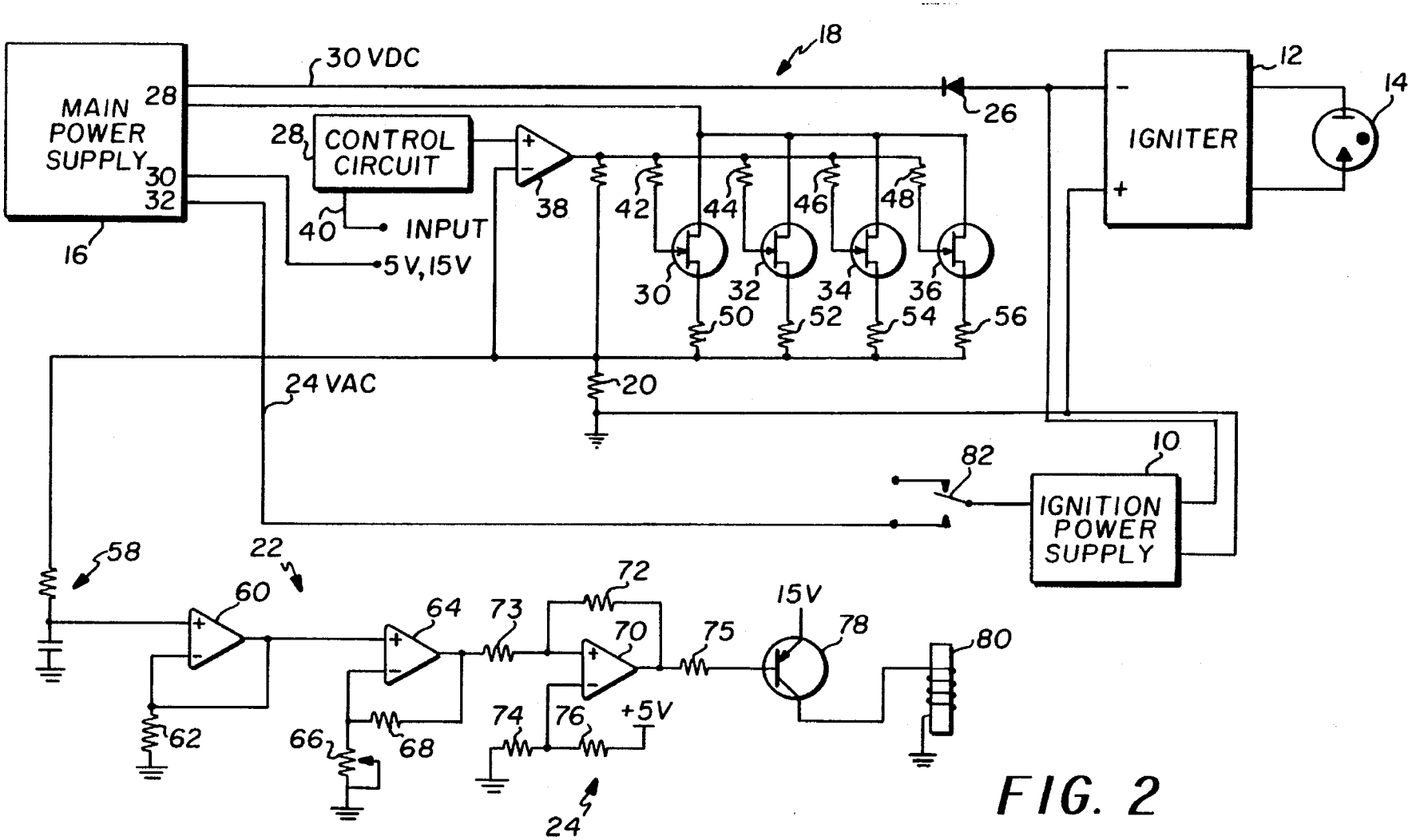
FIG. 2 is a further elaboration of the block diagram of the current mode restart circuit shown in FIG. 1, further showing preferred circuitry for certain of the blocks.

Further detail of the current mode restart circuit is shown in FIG. 2. The main power supply 16, which is arranged to float with respect to ground, includes a transformer with secondary windings for several voltage outputs, including an output 28 for connection to the dc arc lamp 14 through the current driver 18 and the diode 26 (with polarity reversed with respect to FIG. 1 because of the floating supply 16), an output 30 for supplying control circuitry power (e.g., 5v, 15v), and an output 32 for the ignition power supply 10. In this embodiment, the output 28 provides a maximum of 30 volts dc at 25 amps, and the output 32 provides 24 volts ac at 2 amps. The ignition power supply 10 includes another transformer for stepping up the 24 ac volt winding of the main power supply 16 to 140 volts ac for the igniter circuit 12. The current driver 18 includes a control circuit 28 and an array of current control pass transistors, in particular power MOSFET devices 30, 32, 34, and 36, driven by an op-amp driver 38.

The control circuit 28, which is responsive to a current setting input 40, is connected to the non-inverting input of the op-amp driver 38 to set the lamp current between 10 and 25 amps. The value of the current setting input 40 thus determines the constant current value for the dc arc lamp 14. The driver 38 and the MOSFETS 30, 32, 34, 36 form a constant current source with the resistor 20 being the sense resistor. The inverting input of the driver 38 is connected in a feedback loop to monitor the voltage drop across the sense resistor 20, and this drop is compared to the output of the control circuit 38, as applied to the non-inverting input of the driver 38. The output of the driver 38 in effect drives the MOSFETS 30–36 to allow a current through them that causes the voltage drop across the sense resistor 20 to equal the voltage output of the control circuit 28. Small gate resistors 42, 44, 46, 48 serve to dampen any tendency to gate oscillation or ringing. Resistors 50, 52, 54, 56 are also added in each MOSFET source return to facilitate current sharing between the MOSFET devices.

In the current buffer 22, the voltage drop across the sense resistor 20 is processed by a low pass filter 58 and buffered by an op-amp 60 and a resistor 62. The low pass filter 58 eliminates high frequency components above about 5 kHz, which is the bandwidth of the system. Another op-amp 64 provides variable gain through resistors 66 and 68 to scale up the voltage output from the op-amp 60 so as to directly indicate the current with a ratio of 1 volt per 10 amps. (This is useful for lamp current measurement and indication, which is not shown; a gain adjustment at this point is also useful for calibrating the trip point of the comparator 24.) The current comparator 24 includes an op-amp 70 connected up as a comparator with the resistors 72, 73, 74, 75 and 76 so as to trigger at 1.5 amps, which becomes the first trigger level. This level is substantially below the minimum current of the supply, which is 10 amps. The resistor 75 provides a hysteresis characteristic to the comparator 24, such that the op-amp 70 is not disabled until its input current rises above 2.0 amps (the second trigger level), still well below the minimum current of the supply (10 amps). The amount of the hysteresis is regulated by the value of resistors 72 and 73. The output of the op-amp 70 is connected through a relay buffer transistor 78 to the windings of a relay 80, which in turn controls the 24 volt supply to the ignition power supply 10 through the switch contacts 82.

In operation, when the selected constant current is flowing undisturbed to the dc arc lamp 14, the input current to the comparator 24 is well above the first trigger level of 1.5 amps. Consequently, the output of the op-amp 70 is high, the transistor 78 is off, and the relay 80 is open. The ignition power supply 10 is thus inactive. If the current to the lamp 14 is interrupted or extinguished to the extent that the current drops below the first trigger lever of 1.5 amps, the output of the comparator 70 is driven low, the transistor 78 is turned on, and the relay 80 is closed. This connects the 24 volts ac supply through the closed contacts 82 to the ignition power supply 10, and the supply 10 is activated. The 140 ac volt output of the supply 10 is applied to the igniter 12, which includes (not shown) a relaxation oscillator for charging up a capacitor connected to a spark gap. When the capacitor reaches about 7.5 KV, the spark gap avalanches and, through an autotransformer, applies an approximately 22 KV pulse to the lamp 14. The lamp 14 thus fires and ignites. Once the arc is established, current is drawn through the forward biased diode 26 and the open circuit voltage across the lamp 14 drops. As the lamp current rapidly increases toward its constant value, the changing current is sensed by the sense resistor 20 and applied to the comparator 24. As the current ramps upward past the second trigger level of 2.0 amps, the relay 80 is opened, and the ignition power supply 10 is inactivated.

It should also be appreciated that relay 80 may be logically connected to the restart circuitry through a lamp starting control (not shown), which allows use of the ignition power supply 10 to cold start the arc lamp 14. The ignition power supply 10 and the igniter 12 are conventional in circuitry and construction, and consequently, are not shown in detail. Likewise, the main power 16, albeit a floating supply, is conventional. The control circuit 28 is likewise conventional, and relates to the invention only insofar as it aids in specifying a particular constant operating current for the lamp 14.

The invention has been described with reference to a preferred embodiment. However, it will be appreciated that variations and modifications can be effected by a person of ordinary skill in the art without departing from the scope of the invention.

PARTS LIST

10 ignition power supply
12 igniter circuit
14 dc arc lamp
**15*a*** integrating cavity
**15*b*** film
**15*c*** photosensor assembly
**15*d*** power circuit
16 main power supply
18 current driver
20 current sense resistor
22 current buffer

24 comparator
26 diode
28 control circuit
30 MOSFET
32 MOSFET
34 MOSFET
36 MOSFET
38 op amp driver
40 current setting input
42 gate resistor
44 gate resistor
46 gate resistor
48 gate resistor
50 current sharing resistors
52 current sharing resistors
54 current sharing resistors
58 low pass filter
60 op amp
62 resistor
64 op amp
66 resistor
68 resistor
70 op amp
72 resistor
74 resistor
76 resistor
78 relay buffer transistor
80 relay
82 switch contacts

I claim:

1. A restart circuit for a dc arc lamp subject to power variations that cause the lamp to extinguish, said restart circuit comprising:

a power circuit for supplying the dc arc lamp with current, said current being a constant current value while the lamp is operating, said power circuit including a high current power supply and a current driver connected to an output of the power supply for supplying the constant current value;

a current monitor connected to the power circuit for monitoring the current supplied to the dc arc lamp and for providing a current sense signal corresponding to said supplied current;

a comparator connected to receive the current sense signal and to provide a restrart signal having hysteresis characteristic, said restart signal activated when the current sense signal falls a first predetermined value below the constant current value and deactivated when the current sense signal rises above a second predetermined value greater than said first predetermined value, but still less than the constant current value; and an ignition circuit responsive to the restart signal for supplying the dc arc lamp with an ignition voltage to restart the lamp.

2. A restart circuit as claimed in claim 1 in which said ignition circuit supplies the dc arc lamp with said ignition voltage when said current sense signal is increasing between said first and second predetermined values.

3. A restart circuit as claimed in claim 1 in which said power circuit further includes a control circuit connected to an input of the current driver for setting the value of the constant current.

4. A restart circuit as claimed in claim 1 wherein said current driver includes a feedback path through a current sense resistor, and wherein said current monitor is connected to monitor the voltage across the current sense resistor to determine the current supplied to the dc arc lamp.

5. A restart circuit as claimed in claim 1 in which said ignition circuit is connected to the power supply through a relay activated by the restart signal.

6. An illumination system for supplying uniform illumination of a transparent film in a film scanner, said illumination system comprising:

means for providing uniform illumination of the film, said means provided with an input for receiving light;

a dc arc lamp for directing light into the input of said uniform illumination means, said dc arc lamp subject to power variations that cause the lamp to extinguish;

a power circuit for supplying the dc lamp with current, said current being a constant current value while the lamp is operating, said power circuit including a high current power supply and a current driver connected to an output of the power supply for supplying the constant current value;

a current monitor connected to an the power circuit for monitoring the current supplied to the dc arc lamp and for providing a current sense signal corresponding to said supplied current;

a comparator connected to receive the current sense signal and to provide a restart signal having a hysteresis characteristic, said restart signal activated when the current sense signal falls a first predetermined value below the constant current value indicating that the dc arc lamp has been extinguished and deactivated when the current sense signal rises above a second predetermined value greater than said first predetermined value, but still less than the constant current value; and an ignition circuit responsive to the restart signal for supplying the dc arc lamp with an ignition voltage to restart the lamp.

7. An illumination system as claimed in claim 6 in which said ignition circuit supplies the dc arc lamp with said ignition voltage when said current sense signal is increasing between said first and second predetermined values.

8. An illumination system as claimed in claim 6 in which said power circuit further includes a control circuit connected to an input of the current driver for setting the value of the constant current.

9. An illumination system as claimed in claim 6 wherein said current driver includes a feedback path through a current sense resistor, and wherein said current monitor is connected to monitor the voltage across the current sense resistor to determine the current supplied to the dc arc lamp.

10. An illumination system as claimed in claim 6 in which said ignition circuit is connected to the power supply through a relay activated by the restart signal.

* * * * *

UNITED STATES PATENT AND TRADEMARK OFFICE

CERTIFICATE OF CORRECTION

PATENT NO. : 5,479,076
DATED : December 26, 1995
INVENTOR(S) : Gregory O. Moberg It is certified that error appears in the above-indentified patent and that said Letters Patent is hereby corrected as shown below:

Col. 5, line 45 "restrart" should --restart--.
Col. 5, line 45 after "having" insert --a--.

Signed and Sealed this

Twenty-first Day of May, 1996

Bruce Lehman

*Attest:*

BRUCE LEHMAN

*Attesting Officer*

*Commissioner of Patents and Trademarks*